US006615517B2

(12) United States Patent
King

(10) Patent No.: US 6,615,517 B2
(45) Date of Patent: Sep. 9, 2003

(54) BEVERAGE BAUBLE AND ASSOCIATED GLASSWARE

(76) Inventor: Barbara A. King, 1358 Linwood Dr., Holland, MI (US) 49424

( * ) Notice: Subject to any disclaimer, the term of this patent is extended or adjusted under 35 U.S.C. 154(b) by 0 days.

(21) Appl. No.: 10/035,362

(22) Filed: Oct. 26, 2001

(65) Prior Publication Data

US 2002/0059744 A1 May 23, 2002

Related U.S. Application Data

(60) Provisional application No. 60/243,924, filed on Oct. 27, 2000.

(51) Int. Cl.[7] ..... G09F 3/14; G09F 3/16

(52) U.S. Cl. ..... 40/324; 40/665; 40/666

(58) Field of Search ..... 40/310, 324, 665, 40/666; 63/3, 3.1; D7/396.2

(56) References Cited

U.S. PATENT DOCUMENTS

| | | | | | |
|---|---|---|---|---|---|
| 534,946 | A | * | 2/1895 | Bates | 224/220 |
| 605,584 | A | | 6/1898 | Muffly | |
| 1,036,588 | A | * | 8/1912 | Eastburn | 116/72 |
| D47,490 | S | | 6/1915 | Hunter | |
| D80,932 | S | | 4/1930 | Danco | |
| 1,899,284 | A | | 2/1933 | Manhard | |
| 1,971,528 | A | | 8/1934 | Klebanow | |
| 2,064,849 | A | | 12/1936 | Pattillo | |
| D106,976 | S | | 11/1937 | Hokerk | |
| 2,250,666 | A | | 7/1941 | Godefroy | |
| 2,976,629 | A | | 3/1961 | Brixius et al. | |
| 3,086,268 | A | * | 4/1963 | Chaffin, Jr. | 24/303 |
| D256,899 | S | | 9/1980 | Mazzini | |
| 4,271,616 | A | * | 6/1981 | Boykin | 40/659 |
| D269,863 | S | | 7/1983 | Meyer | |
| 4,483,622 | A | | 11/1984 | Muhi et al. | |
| 4,680,882 | A | | 7/1987 | Watson, Jr. | |
| 4,908,244 | A | | 3/1990 | Bullock | |
| 4,951,596 | A | | 8/1990 | Wallace, Jr. | |
| 5,261,176 | A | | 11/1993 | David et al. | |
| 5,311,688 | A | * | 5/1994 | Aeschbacher et al. | 40/665 |
| 5,339,549 | A | | 8/1994 | David et al. | |
| 5,358,770 | A | | 10/1994 | Evans | |
| 5,581,921 | A | * | 12/1996 | Hutchens | 40/324 |
| D406,213 | S | | 3/1999 | Rausch | |
| D414,435 | S | | 9/1999 | Nahon | |
| 6,082,030 | A | | 7/2000 | Kesselring et al. | |
| 6,086,702 | A | | 7/2000 | Rea | |
| 6,293,034 | B1 | * | 9/2001 | Skapyak et al. | 40/310 |
| D459,151 | S | | 6/2002 | Skapyak | |
| 6,422,036 | B1 | * | 7/2002 | Giannis et al. | 63/3.1 |
| 6,530,163 | B2 | * | 3/2003 | Skapyak et al. | 40/310 |

FOREIGN PATENT DOCUMENTS

| | | | | |
|---|---|---|---|---|
| FR | 2484678 | * | 12/1981 | 40/310 |

* cited by examiner

*Primary Examiner*—Brian K. Green
(74) *Attorney, Agent, or Firm*—King & Jovanovic, PLC

(57) ABSTRACT

A beverage bauble comprising: (a) a glassware engaging member associable with a piece of beverage glassware, wherein the glassware engaging member comprises: (1) a primary aperture, wherein the primary aperture is releasably securable around a portion of the piece of beverage glassware; and (2) at least one structural configuration which releasably secures the glassware engaging member to the piece of beverage glassware; and (b) a primary identifier, wherein the primary identifier includes a connector which secures the primary identifier to the glassware engaging member.

3 Claims, 6 Drawing Sheets

BEVERAGE BAUBLE AND ASSOCIATED GLASSWARE

CROSS-REFERENCE TO RELATED APPLICATION(S)

This application claims the benefit of U.S. Provisional Application Ser. No. 60/243,924, filed Oct. 27, 2000, the entirety of which is hereby incorporated herein by reference.

BACKGROUND OF THE INVENTION

Field of the Invention

The present invention relates in general to beverage glassware, and more particularly, to beverage glassware having a beverage bauble associated therewith which, among other things, allows a user to correctly identify such beverage glassware with substantial ease, convenience, and class.

Beverage glassware has been known in the art for several years. Furthermore, the use of beverage glassware, and more particularly, the use of a plurality of identically or similarly designed beverage glassware while at a single location, such as a party or dinner, has been known and practiced in the art for several years. While use of such identically or similarly designed beverage glassware may be desirous for economic, practical, and aesthetic reasons, it remains non-desirous and/or problematic inasmuch as, to the best of Applicant's knowledge, the use of such beverage glassware is not conducive to distinguishing one piece of glassware from another. Therefore, substantial effort is required of users in order to prevent a plurality of potentially distressing situations associated with indistinguishable beverage glassware, such as, for example, inadvertently drinking from someone else's glassware and having to deal with any potential health risks associated therewith. While a practiced attempt to solve the aforementioned detriments and/or complications has been to write the user's name on the glass, such a practice, depending on the setting, is not always socially acceptable and/or desirable.

It is therefore an object of the present invention to provide beverage glassware having a beverage bauble associated therewith which, among other things, remedies the aforementioned detriments and/or complications associated with the use of beverage glassware without the same.

SUMMARY OF THE INVENTION

The present invention is directed to a beverage bauble comprising: (a) a glassware engaging member associable with a piece of beverage glassware, wherein the glassware engaging member comprises: (1) a primary aperture, wherein the primary aperture is releasably securable around at least a portion of the piece of beverage glassware; and (2) means for releasably securing the glassware engaging member to the piece of beverage glassware; and (b) a primary identifier, wherein the primary identifier includes a connector which secures the primary identifier to the glassware engaging member.

In a preferred embodiment of the present invention, the releasable securement means consists of: (a) a secondary aperture associated with the glassware engaging member; and (b) a prong, wherein the prong is releasably securable within the secondary aperture.

In another preferred embodiment of the present invention, the releasable securement means consists of a first hook and a second hook, wherein the first hook is releasably securable to the second hook.

The present invention is also directed to a beverage bauble comprising: (a) a glassware engaging member associable with a piece of beverage glassware, wherein the glassware engaging member comprises: (1) a primary aperture, wherein the primary aperture is releasably securable around at least a portion of the piece of beverage glassware; and (2) means for releasably securing the glassware engaging member to the piece of beverage glassware; (b) a primary identifier, wherein the primary identifier includes a connector which secures the primary identifier to a jump ring; and (c) a jump ring, wherein the jump ring secures the connector to the glassware engaging member.

According to the present invention, a beverage bauble is disclosed, comprising: (a) a glassware engaging member associable with a piece of beverage glassware, wherein the glassware engaging member comprises: (1) a primary aperture, wherein the primary aperture is releasably securable around at least a portion of the piece of glassware; and (2) means for releasably securing the glassware engaging member to the piece of beverage glassware; (b) a primary identifier, wherein the primary identifier includes a connector which secures the primary identifier to a jump ring; (c) a jump ring, wherein the jump ring secures the connector to the glassware engaging member; and (d) at least one supplemental identifier associated with the glassware engaging member, wherein the at least one supplemental identifier includes an aperture, and further wherein the glassware engaging member is positioned within the aperture of the at least one supplemental identifier.

The present invention is further directed to a piece of beverage glassware comprising: (a) a beverage reservoir; (b) at least one of a stem and a handle; (c) a base; and (d) a beverage bauble as provided herein, wherein the beverage bauble is releasably secured to at least one of the stem and the handle.

BRIEF DESCRIPTION OF THE DRAWINGS

The invention will now be described with reference to the drawings wherein.

DETAILED DESCRIPTION OF THE INVENTION

Figure 1:
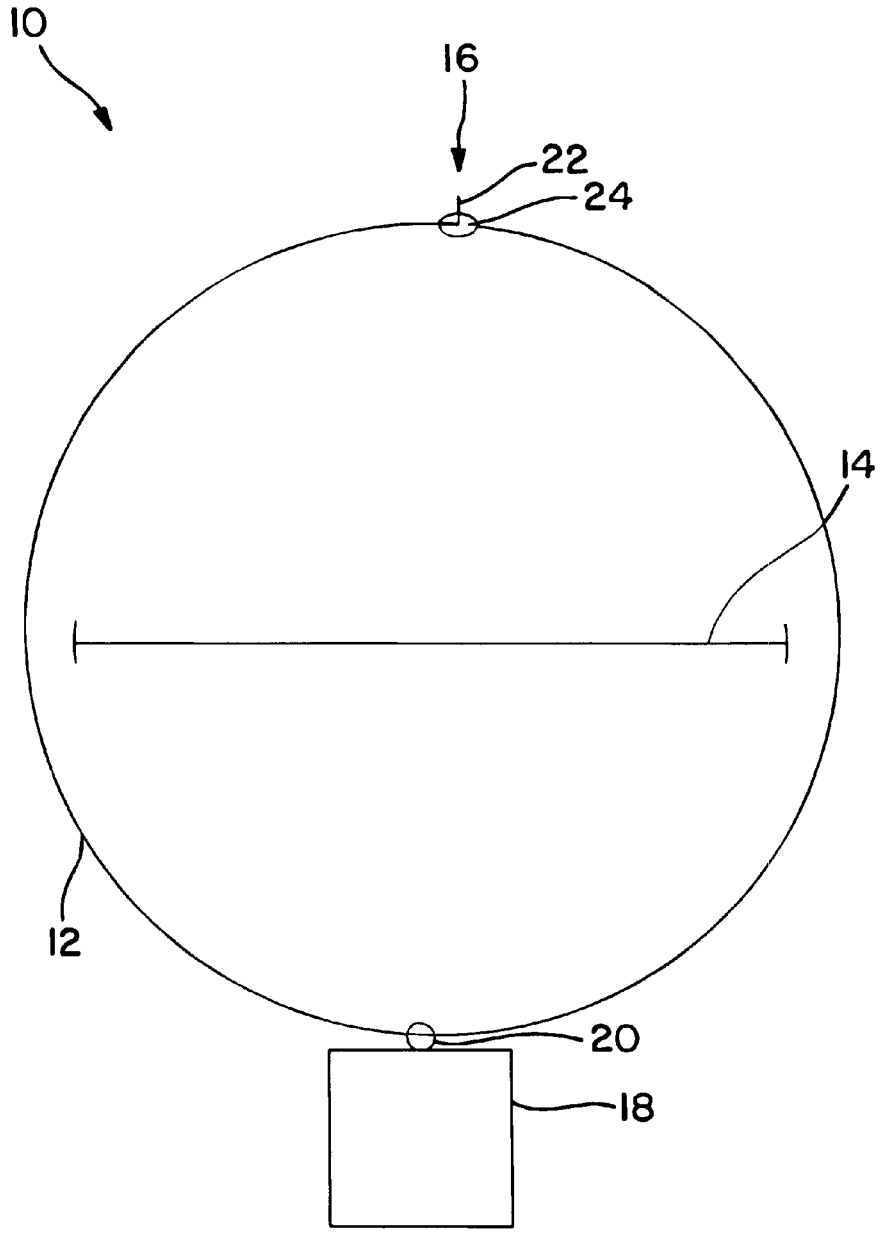
FIG. 1 of the drawings is a perspective view of a first embodiment of a beverage bauble fabricated in accordance with the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Figure 2:
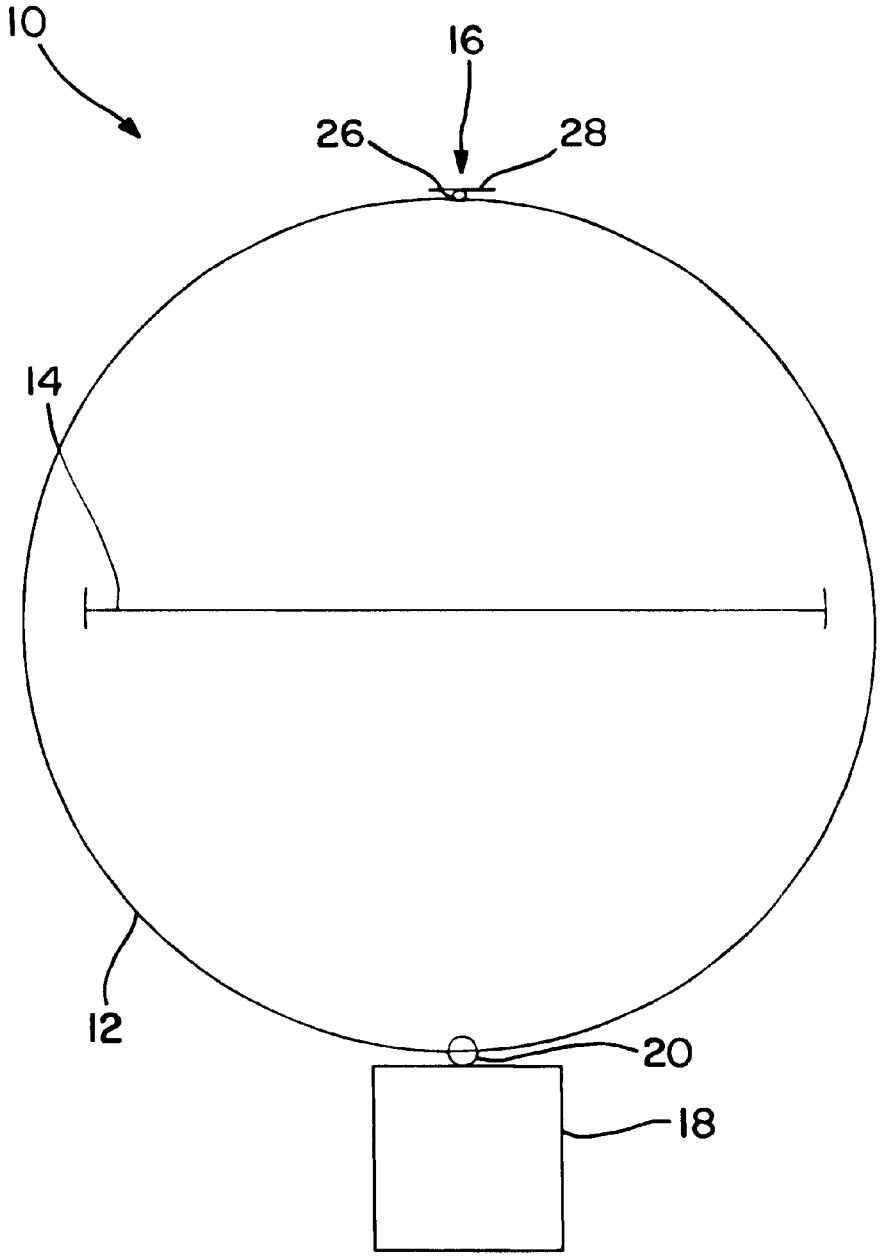
FIG. 2 of the drawings is a perspective view of a second embodiment of a beverage bauble fabricated in accordance with the present invention.

Referring now to the drawings, and to FIGS. 1 and 2 in particular, perspective representations of first and second embodiments of beverage bauble 10 are shown, which generally comprise glassware engaging member 12, primary aperture 14, releasable securement means 16, primary identifier 18, and connector 20. It will be understood that FIGS. 1–7 are merely representations of beverage bauble 10 and glassware 50. As such, some of the components may be distorted from their actual scale for pictorial clarity.

For purposes of the present disclosure, glassware engaging member 12 is associable with a piece of beverage glassware 50 (see FIGS. 6A–C and 7A–C) via releasable securement means 16. When releasable securement means 16 is engaged, glassware engaging member 12 may completely enclose primary aperture 14, and may comprise any one of a number of shapes known to those having ordinary skill in the art with the present disclosure before them, such as, but not limited to, a substantially circular, elliptical, polygonal, triangular, arbitrary shape, etcetera. Glassware engaging member 12 may be fabricated from any one of a number of materials known to those having ordinary skill in the art with the present disclosure before them, such as, but not limited to, a natural or synthetic resin, plastic, glass, metal, alloy, composite, and/or any combination thereof—its only limitation being that it must be releasably securable around glassware 50.

Primary aperture 14 may be partially or completely enclosed by glassware engaging member 12, and must be large enough to accommodate at least a portion of glassware 50.

Figure 3:
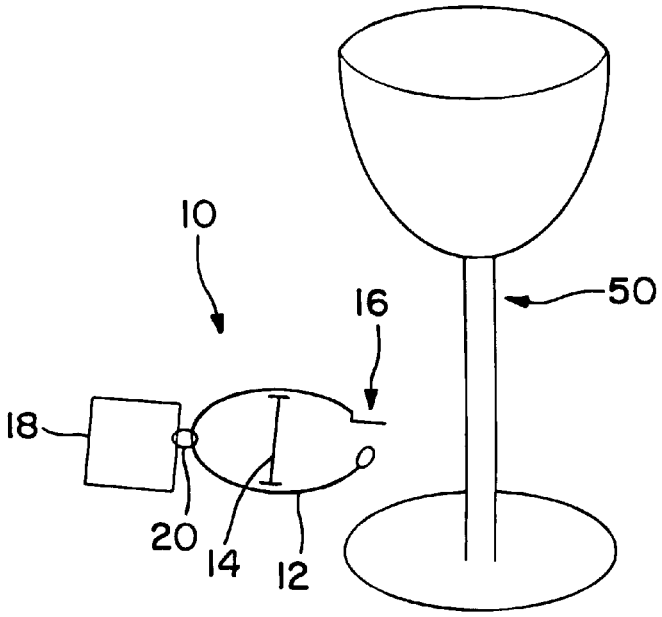
FIG. 3 of the drawings is a perspective view of a piece of beverage glassware and a beverage bauble, fabricated in accordance with the present invention, showing, among other things, the releasable securement means of the beverage bauble around the piece of beverage glassware while the same is disengaged.
Figure 4:
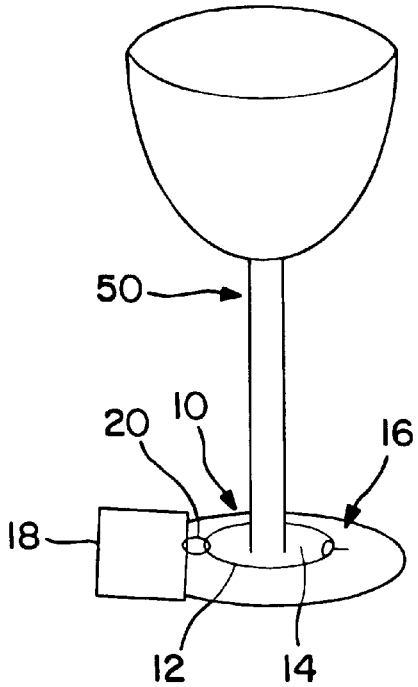
FIG. 4 of the drawings is a perspective view of a piece of beverage glassware and a beverage bauble, fabricated in accordance with the present invention, showing, among other things, the releasable securement means of the beverage bauble around the piece of beverage glassware while the same is engaged.

Referring now to FIGS. 3 and 4, collectively, releasable securement means 16 may be disengaged and engaged, thereby partially enclosing and completely enclosing glassware engaging member 12 around primary aperture 14. As is shown in FIG. 3, when releasable securement means 16 is disengaged, primary aperture 14 is only partially enclosed by glassware engaging member 12, and glassware 50 may be received by or released from primary aperture 14 of glassware engaging member 12. As is shown in FIG. 4, when releasable securement means 16 is engaged, primary aperture 14 is completely enclosed by glassware engaging member 12, thereby releasably securing glassware 50 within primary aperture 14 of glassware engaging member 12.

Referring once again to FIG. 1, in a first embodiment of beverage bauble 10, releasable securement means 16 may comprise prong 22 and secondary aperture 24. Secondary aperture 24 is associated with glassware engaging member 12, and is configured to receive and releasably secure prong 22, thereby engaging releasable securement means 16. Alternatively, referring once again to FIG. 2, in a second embodiment of beverage bauble 10, releasable securement means 16 may comprise first hook 26 and second hook 28. First hook 26 is releasably securable to second hook 28, in order to engage releasable securement means 16.

Primary identifier 18 may be uniquely shaped and/or colored and comprises connector 20. The uniquely shaped and/or colored primary identifier 18 may identify glassware 50 from another piece of glassware inasmuch as glassware 50, having primary identifier 18 of beverage bauble 10 associated therewith, is different in appearance than other pieces of glassware present. Primary identifier 18 may comprise, for example, a bead, ornament, charm, trinket, and/or object, and may be fabricated from any one of a number of materials known to those having ordinary skill in the art with the present disclosure before them, such as, but not limited to, a natural or synthetic resin, plastic, fabric, glass, wood, metal, alloy, composite, and/or any combination thereof.

Figure 5:
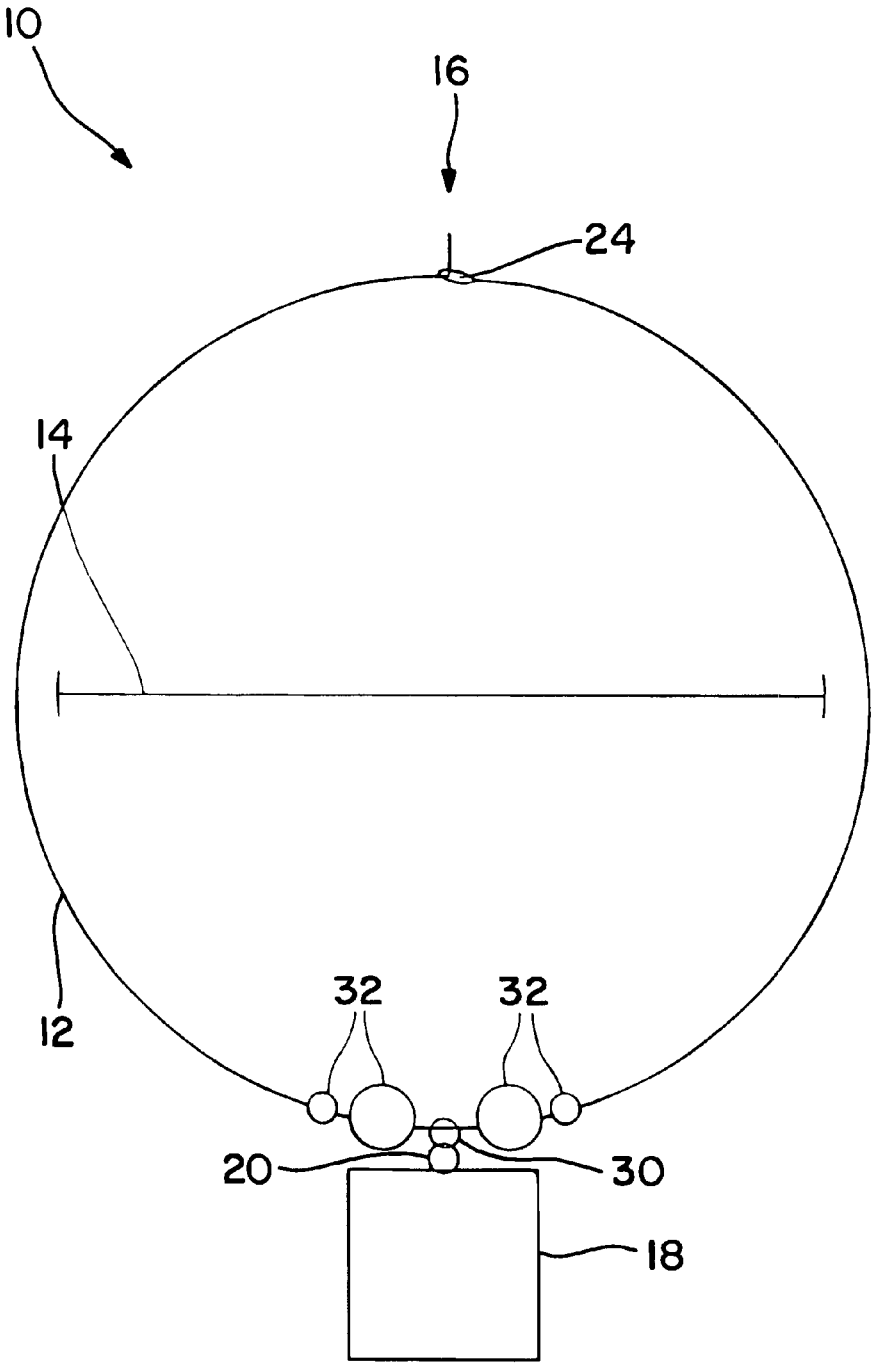
FIG. 5 of the drawings is a perspective view of a third embodiment of a beverage bauble fabricated in accordance with the present invention.
Figure 6A:
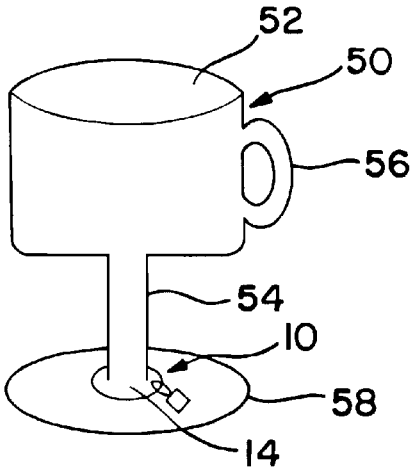
FIGS. 6A–C of the drawings are perspective views of a plurality of pieces of beverage glassware having beverage baubles thereon, fabricated in accordance with the present invention.
Figure 6B:
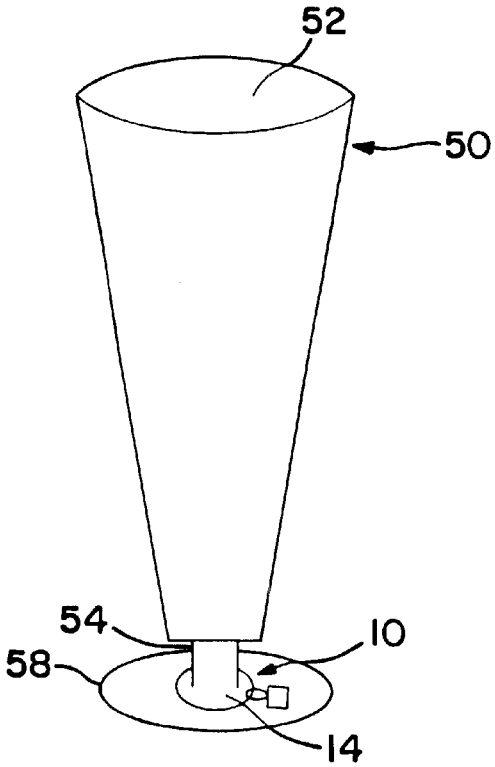
Figure 6C:
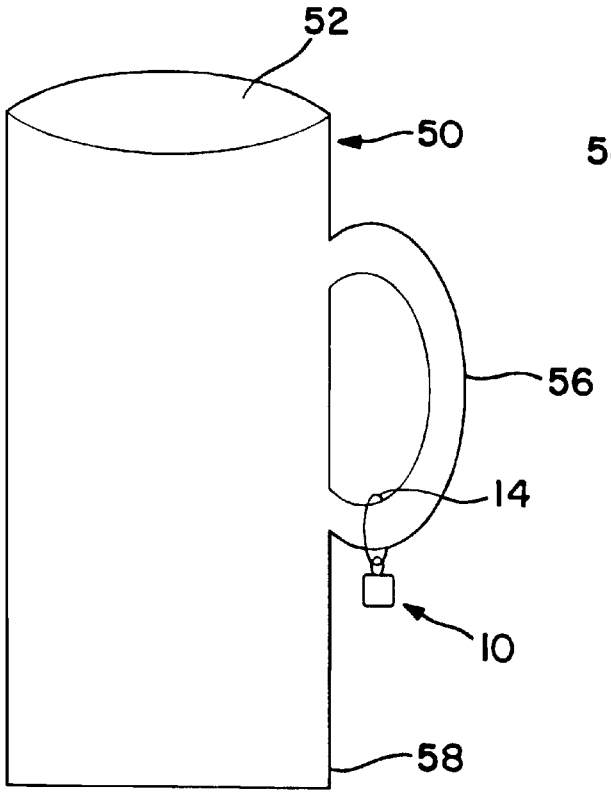
Figure 7A:
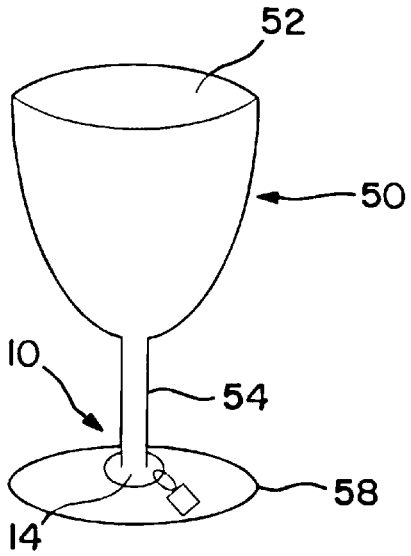
FIGS. 7A–C of the drawings are perspective views of a plurality of pieces of beverage glassware having beverage baubles thereon, fabricated in accordance with the present invention.
Figure 7B:
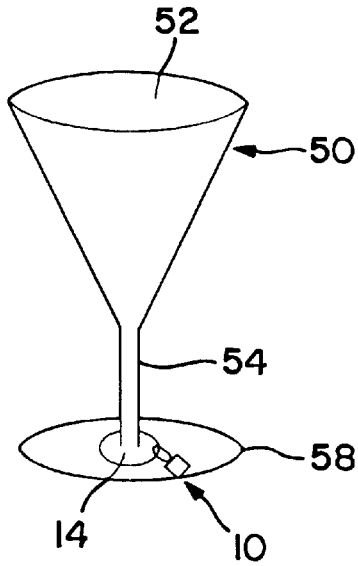
Figure 7C:
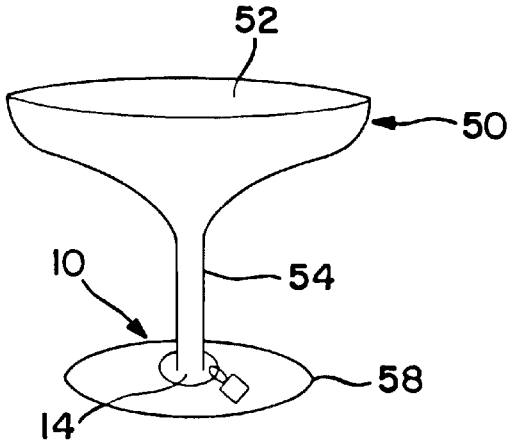

Connector 20 is attached to primary identifier 18. Connector 20 is capable of securing primary identifier 18 to another member of beverage bauble 10. For example, as seen in FIGS. 1–4, connector 20 may secure primary identifier 18 to glassware engaging member 12. Alternatively, as is shown in FIG. 5, if a jump ring 30 or other such additional member is comprised in beverage bauble 10, connector 20 may secure primary identifier 18 thereto. As is shown in FIGS. 1–7, connector 20 may comprise a looped aperture within which glassware engaging member 12, jump ring 30, or another such additional member may be positioned and/or secured.

Referring now to FIG. 5, a third embodiment of beverage bauble 10 is shown as further comprising jump ring 30 and at least one supplemental identifier 32. It will be understood that additional embodiments may be analogous to those in FIG. 1 and/or FIG. 2, and further comprise at least one of jump ring 30 and/or at least one of supplemental identifier 32.

Jump ring 30 is capable of securing connector 20 to glassware engaging member 12. As is shown in FIG. 5, jump ring 30 may comprise a ring which may open and close, and contains an aperture within which glassware engaging member 12 and connector 20 may be positioned and/or secured.

Supplemental identifier 32 may be uniquely shaped and/or colored and may include an aperture therein, within which glassware engaging member 12 may be positioned and/or secured. Alternatively, although not shown, it will be understood that it is contemplated that supplemental identifier 32 may be secured to beverage bauble 10 in a manner analogous to that which secures primary identifier 18 to beverage bauble 10. It will be understood that supplemental identifier 32 may be present on beverage bauble 10 in any number. For example, primary identifier 18 may be sufficient for identification purposes of glassware 50, thereby no supplemental identifier is present, or, alternatively, one, two, three, four, etcetera, supplemental identifiers 32 may be present on beverage bauble 10. Supplemental identifier 32 may accompany primary identifier 18 in identifying glassware 50 from another piece of glassware inasmuch as glassware 50, having primary identifier 18 and supplemental identifier 32 of beverage bauble 10 associated therewith, is different in appearance than other pieces of glassware present. Supplemental identifier 32 may comprise, for example, a bead, ornament, charm, trinket, and/or object, and may be fabricated from any one of a number of materials known to those having ordinary skill in the art with the present disclosure before them, such as, but not limited to, a natural or synthetic resin, plastic, fabric, glass, wood, metal, alloy, composite, and/or any combination thereof. If a plurality of supplemental identifiers 32 is present, they may be the same or different.

Referring now to FIGS. 6A–C and 7A–C, collectively, a plurality of types of beverage glassware 50 are shown. It will be understood that it is contemplated that beverage bauble 10 may be releasably secured to any of the types of beverage glassware 50 shown. For example, beverage bauble 10 may be releasably secured to a wineglass, beer stein, beer mug, champagne glass, martini glass, margarita glass, or mug, etcetera. Furthermore, it is contemplated that beverage bauble 10 may be releasably secured to any beverage glassware which is not shown but which is known to those having ordinary skill in the art, so long as the beverage glassware comprises a portion to which beverage bauble 10 may be releasably secured and is used for filling with a beverage consumable by humans.

Beverage glassware 50 may comprise reservoir 52, base 58, and at least one of stem 54, and handle 56. Reservoir 52 is configured to receive and hold a liquid. Base 58 is configured for association with a flat surface and resting thereon. In embodiments where present, stem 54 extends from reservoir 52 to base 58, and may be grasped by a user during use of beverage glassware 50. Alternatively, in embodiments where present, handle 56 may be grasped by a user during use of beverage glassware 50. At least one of stem 54 and handle 56 may be releasably secured within primary aperture 14 of beverage bauble 10. Although the term glassware inherently invokes a material image of glass, it will be understood that beverage glassware 50 may be fabricated from any one of a number of materials known to those having ordinary skill in the art with the present disclosure before them, such as, but not limited to, a natural or synthetic resin, plastic, glass, wood, metal, alloy, composite, and/or any combination thereof.

A process for identifying a piece of beverage glassware is also disclosed, which comprises the steps of providing a piece of beverage glassware and providing a beverage bauble. For purposes of the present disclosure, the step of providing a piece of beverage glassware may include providing one or more of the above-identified, disclosed pieces of beverage glassware. Likewise, the step of providing a beverage bauble may include providing one or more of the above-identified, disclosed beverage baubles. After the steps of providing the piece of beverage glassware and beverage bauble, the beverage bauble is then associated with at least one of the handle and stem of the beverage glassware to identify the same.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A piece of beverage glassware, comprising:
- a beverage reservoir;
- at least one of a stem and a handle;
- a base; and
- a beverage bauble, wherein the beverage bauble is releasably secured to at least one of the stem and the handle, and wherein the beverage bauble comprises:
  - a glassware engaging member associable with the piece of beverage glassware, wherein the glassware engaging member comprises:
    - a primary aperture, wherein the primary aperture is releasably securable around at least a portion of the piece of beverage glassware; and
    - means for releasably securing the glassware engaging member to the piece of beverage glassware, wherein the releasable securement means consists of:
      - a secondary aperture associated with the glassware engaging member; and
      - a prong, wherein the prong is releasably securable within the secondary aperture; and
  - a primary identifier, wherein the primary identifier includes a connector which secures the primary identifier to the glassware engaging member.

2. A piece of beverage glassware, comprising:
- a beverage reservoir;
- at least one of a stem and a handle;
- a base; and
- a beverage bauble, wherein the beverage bauble is releasably secured to at least one of the stem and the handle, and wherein the beverage bauble comprises:
  - a glassware engaging member associable with the piece of beverage glassware, wherein the glassware engaging member comprises:
    - a primary aperture, wherein the primary aperture is releasably securable around at least a portion of the piece of beverage glassware; and
    - means for releasably securing the glassware engaging member to the piece of beverage glassware, wherein the releasable securement means consists of:
      - a secondary aperture associated with the glassware engaging member; and
      - a prong, wherein the prong is releasably securable within the secondary aperture; and
  - a primary identifier, wherein the primary identifier includes a connector which secures the primary identifier to a jump ring; and
  - the jump ring, wherein the jump ring secures the connector to the glassware engaging member.

3. A piece of beverage glassware, comprising:
- a beverage reservoir;
- at least one of a stem and a handle;
- a base; and
- a beverage bauble, wherein the beverage bauble is releasably secured to at least one of the stem and the handle, and wherein the beverage bauble comprises:
  - a glassware engaging member associable with the piece of beverage glassware, wherein the glassware engaging member comprises:
    - a primary aperture, wherein the primary aperture is releasably securable around at least a portion of the piece of beverage glassware; and
    - means for releasably securing the glassware engaging member to the piece of beverage glassware, wherein the releasable securement means consists of:
      - a secondary aperture associated with the glassware engaging member; and
      - a prong, wherein the prong is releasably securable within the secondary aperture;
  - a primary identifier, wherein the primary identifier includes a connector which secures the primary identifier to a jump ring;
  - the jump ring, wherein the jump ring secures the connector to the glassware engaging member; and
  - at least one supplemental identifier associated with the glassware engaging member, wherein the at least one supplemental identifier includes an aperture, and further wherein the glassware engaging member is positioned within the aperture of the at least one supplemental identifier.

* * * * *